US005819724A

United States Patent [19]

Hybertson

[11] Patent Number: 5,819,724

[45] Date of Patent: Oct. 13, 1998

[54] FRICTION HEAT DEVELOPER

[76] Inventor: Verlyn Hybertson, 400 South St., P.O. Box 249, Centerville, S. Dak. 57014

[21] Appl. No.: 647,116

[22] Filed: May 9, 1996

[51] Int. Cl.[6] ..... F24C 9/00

[52] U.S. Cl. ..... 126/247; 122/26

[58] Field of Search ..... 122/26; 126/247

[56] References Cited

U.S. PATENT DOCUMENTS

| | | | |
|---|---|---|---|
| 1,682,102 | 8/1928 | Allen . | |
| 1,758,207 | 5/1930 | Walker | 126/247 X |
| 3,245,399 | 4/1966 | Lawson | 126/247 |
| 3,720,372 | 3/1973 | Jacobs | 126/247 |
| 4,254,758 | 3/1981 | Banks | 126/247 |
| 4,366,803 | 1/1983 | Hodge | 126/247 |
| 4,389,915 | 6/1983 | Shafran | 126/247 |
| 4,462,386 | 7/1984 | Powell | 126/247 |
| 4,590,918 | 5/1986 | Kuboyama | 126/247 |
| 4,596,077 | 6/1986 | Kuboyama | 34/15 |

*Primary Examiner*—Carl D. Price

[57] ABSTRACT

A friction-generated heat device using oil as a medium. The device uses a unique disc and housing which continuously generates heat and causes the medium to flow from the center to the perimeter of the disc where the medium is collected and discharged to a point where it can be used to provide heat.

5 Claims, 1 Drawing Sheet

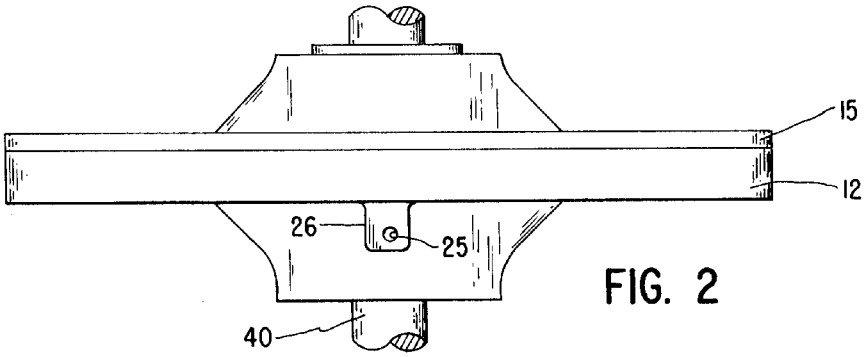
FIG. 2
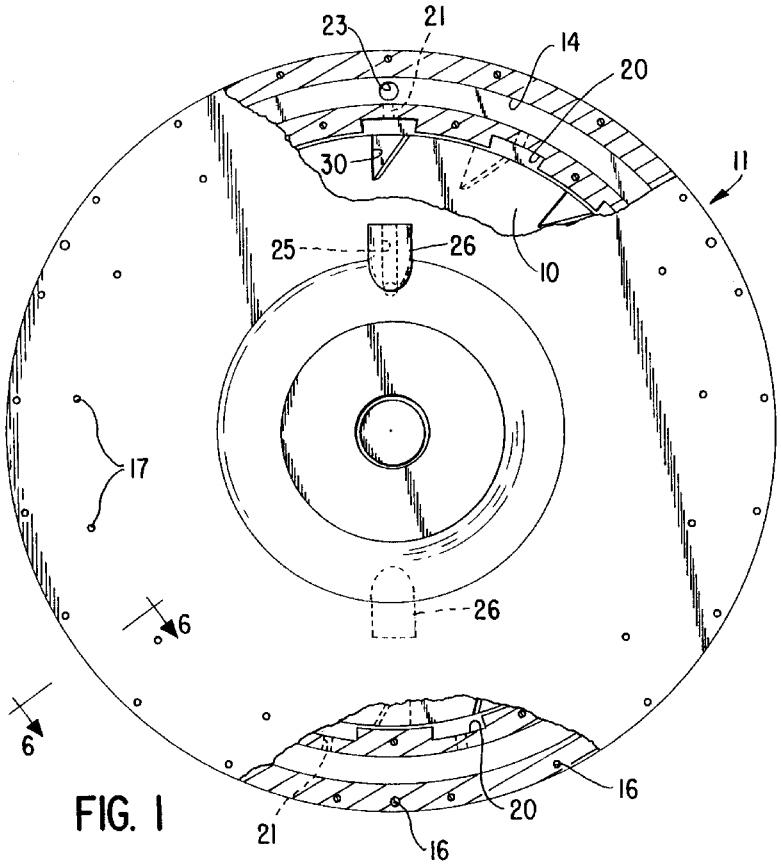
FIG. 1
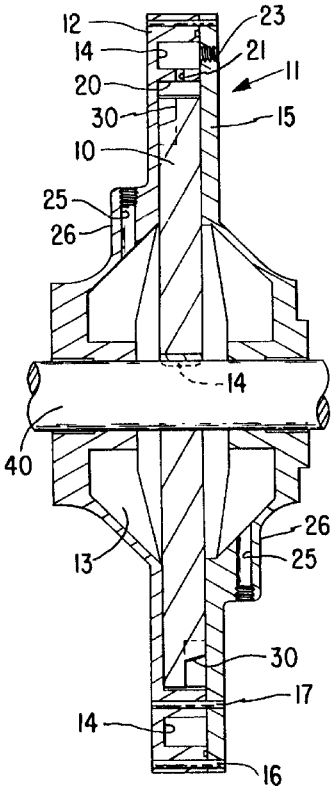
FIG. 3
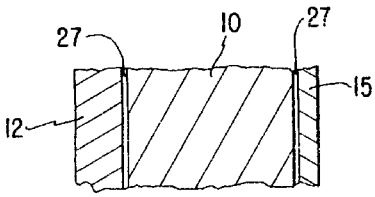
FIG. 6
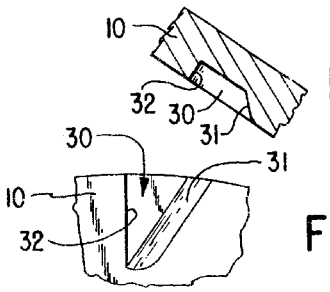
FIG. 5
FIG. 4

FRICTION HEAT DEVELOPER

BACKGROUND AND SUMMARY OF THE INVENTION

This invention pertains to friction generating heat devices, and more particularly to a rotating disc device using oil or similar viscous liquid as a heat absorbing medium to carry the heat to a remote point.

The generation of heat by frictional devices is well known. Efficient transmission of that heat is often desired, and liquid materials are at times desired because of the compactness of the pipe or tubing as compared with ducts for air or other gaseous materials.

Because of the compactness, it is also well accepted that heat generation is possible by friction in the liquid itself. This invention discloses a device of that type using a unique disc in a surrounding housing. The disc is driven through a shaft device by an engine or similar motive power. Liquid introduced at the hub of the disc is heated by friction and impelled to the periphery of the disc where it is collected in a manifold for transmission to the point of use. The disc is found to both enhance the friction and to impel the liquid.

BRIEF DESCRIPTION OF THE DRAWINGS

FIG. 1 is plan view of the device with parts of the casing broken away to show underlying parts, FIG. 2 is an edge view of the enclosed generator, FIG. 3 is a medial sectional view of the device shown in FIG. 1, FIG. 4 is a detailed view to an enlarged side of one notch on the periphery of the disc, FIG. 5 is a view looking directly into the notch shown in FIG. 4, and FIG. 6 is a partial sectional view to an enlarged scale from line 6—6 of FIG. 1.

DESCRIPTION

Briefly this invention is an improved disc-type friction heat generator having impeller notches both to augment the friction and to provide impetus for moving the liquid which is used as a transmitter of the heat.

More specifically, the principal operating mechanism is shown in FIGS. 1–3 and includes a disc 10 enclosed in a housing shown generally at 11. The housing 11 is composed of two similar (but not identical) plates. A chambered plate 12 includes a disc chamber 13 in which the disc 10 runs and also an annular groove 14 which forms a manifold for the collection of the heat carrying liquid. The cover plate 15 is aligned with the chambered plate 11 by dowels 16 and the two plates may be fastened together by bolts extending through holes 17.

Receiving notches 20 are cut into the periphery of the disc chamber 13 to receive heated oil from the outer edge of the disc 10. Holes 21 extend from these notches to the manifold groove 14 so that oil can be discharged into the manifold from which it may be carried through an opening 23 into a discharge pipe, tube or the like to the place where the heat is needed.

Oil (or other heat carrying liquid) is introduced into the housing 11 through similar openings 25 in bosses 26 formed on the plates 12 and 15. From there it runs (is pumped) through narrow spaces 27 (FIG. 6) between the disc 10 and the plates 12 and 15. In practice, this space should be on the order of 0.040 inches, but may vary with the viscosity of the liquid and with the amount of heat desired to be produced.

At its periphery the disc 10 is formed with a series of pumping notches 30. These pumping notches are spaced about the disc and alternate from one side of the disc to the other. They are roughly triangular in form as shown (FIGS. 1 and 4) and have a sloping entry edge 31 and a trailing edge 32 substantially radial in direction or perpendicular to the direction of motion (FIGS. 4 and 5). The depth of the notch is about half the thickness of the disc so that it picks up the liquid from one side of the plate 10 and impels it outwardly through the receiving notch 20 to be expelled through the holes 21 into the annular chamber 14. For added efficiency, the face 32 of the notch is roughly perpendicular to the direction of its motion while the entry slope 31 is sloped to allow less turbulent entry of the liquid into the notch.

Power to rotate the plate 10 is delivered through a shaft 40 fixed to the disc 10. The figures indicate a key 41 engaged between a plate 10 and shaft 40. However, it may be desirable to use a tight press fit, a splined shaft or any other means to be sure the rotation of the shaft is transmitted to the disc. The shaft 40 is journalled in bearings in the housing plates 12 and 15.

In use, the shaft 40 is driven rotatably by an internal combustion engine or some other suitable source of rotating power. Oil (or other viscous liquid) is introduced into the chamber 13 through the openings 25. As the disc 10 is rotated, the liquid is squeezed through the gaps 27 toward the periphery of the disc. Before it reaches that outer edge, the liquid is picked up by the pumping notches 30 and is impelled outwardly. This action forces the liquid into the receiving notches 20 and out through the holes 21 into the chamber 14. From here the liquid can be removed through the hole 23 to be transmitted to the point where the heat can be used. It is obvious that the friction generated by the pumping action and the running through the narrow gaps 27 will cause substantial friction resulting in generation of heat so that when the liquid is discharged it will have a considerably raised temperature for use at the end point.

I claim as my invention:

1. A friction type heat generator comprising a housing, a shaft journalled in said housing, a circular disc fixed to said shaft for rotation within said housing, said housing having lateral walls slightly spaced from said disc, means for inserting liquid into said housing near said shaft and exit means from said housing for said liquid, said exit means including an annular chamber in said housing spaced radially from said disc, circumferentially extended notches in said housing adjacent the periphery of said disc, and restricted exit holes in said housing leading from said circumferentially extended notches to said annular chamber whereby liquid is caught in said notches and is transmitted to said annular chamber and means for providing exit for said liquid from said annular chamber.

2. The heat generator of claim 1 in which the opening between the disc and the walls of the housing is of the order of 0.040 inches.

3. The heat generator of claim 1 in which said disc is formed with pumping notches at the periphery of said disc, said pumping notches being adapted to deliver said liquid to said circumferentially extended notches in said housing.

4. The heat generator of claim 3 in which said disc includes pumping notches on both sides of said disc, said pumping notches are of a depth less than the thickness of said disc.

5. The heat generator of claim 3 in which each pumping notch has an entry edge on a side of said notch toward the direction of rotation of said disc and a trailing edge forming a notch with said entry edge, said trailing edge being substantially radial of said disc, said entry edge providing a sloped entry into said pumping notch.

* * * * *